US007100864B2

(12) United States Patent
Weis

(10) Patent No.: US 7,100,864 B2
(45) Date of Patent: Sep. 5, 2006

(54) TURNING BAR

(75) Inventor: Anton Weis, Lorsch (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 228 days.

(21) Appl. No.: 10/469,981

(22) PCT Filed: Mar. 6, 2002

(86) PCT No.: PCT/DE02/00803

§ 371 (c)(1),
(2), (4) Date: Dec. 17, 2003

(87) PCT Pub. No.: WO02/074673

PCT Pub. Date: Sep. 26, 2002

(65) Prior Publication Data

US 2004/0089693 A1 May 13, 2004

(30) Foreign Application Priority Data

Mar. 15, 2001 (DE) ..... 101 12 415

(51) Int. Cl.
*B65H 23/32* (2006.01)

(52) U.S. Cl. ..... 242/615.12

(58) Field of Classification Search ..... 242/615.1, 242/615.12, 548, 548.4, 566, 615.11; 226/97.1, 226/97.3

See application file for complete search history.

(56) References Cited

U.S. PATENT DOCUMENTS

| | | | | |
|---|---|---|---|---|
| 3,599,851 | A * | 8/1971 | Hedlund et al. | 242/615.12 |
| 3,679,116 | A * | 7/1972 | Hamlin et al. | 242/615.12 |
| 4,453,465 | A | 6/1984 | Heller et al. | |
| 4,938,404 | A * | 7/1990 | Helms et al. | 226/10 |
| 5,357,859 | A * | 10/1994 | Eckert | 101/228 |
| 5,464,143 | A | 11/1995 | Hansen | |
| 5,520,317 | A * | 5/1996 | Eckert et al. | 242/615.12 |

FOREIGN PATENT DOCUMENTS

| | | |
|---|---|---|
| DE | 34 36 870 C1 | 5/1986 |
| DE | 93 20 281.4 U1 | 4/1994 |

* cited by examiner

*Primary Examiner*—Kathy Matecki
*Assistant Examiner*—Scott Haugland
(74) *Attorney, Agent, or Firm*—Jones,Tullar&Cooper, P.C.

(57) ABSTRACT

A turning bar is used to turn a web of material. The turning bar includes an outer jacket that is provided with holes on at least one section of its circumference. An inner chamber of the turning bar is provided with compressed air. A piston is arranged in the inner chamber and is movable to block selected ones of the holes. A motor is used to move the piston via a control signal provided by a control circuit. The turning bar can be pivoted by 90° on a frame around a pivot axis that is perpendicular to a longitudinal axis of the turning bar. A transmission couples a rotational movement of the piston around the longitudinal axis to a pivoting motion of the turning bar.

30 Claims, 6 Drawing Sheets

TURNING BAR

FIELD OF THE INVENTION

The present invention is directed to a turning bar for deflecting a web of material. The turning bar has a jacket with a plurality of holes and an interior compressed air compartment with a movable blocking element.

BACKGROUND OF THE INVENTION

Turning bars are used, in particular, at the output side of a rotary printing press if it is necessary to reroute several partial webs into which a paper web imprinted in the rotary printing press has been cut and which partial webs leave the press, lying next to each other, to a cutting device, in such a way that the partial webs can be placed on top of each other, folded, if necessary, and further processed.

DE 34 36 870 C1 discloses a turning bar. Displaceable pistons have a shape of their free ends which is matched to the course of travel of the web. These pistons can be rotated over 180°.

Turning bars, which are configured with an interior which can be supplied with compressed air, are known from U.S. Pat. No. 5,464,143 A. The jacket of the turning bar is provided with holes over at least a part of its circumference. Air can escape through these holes from the interior of the turning bar in order to form an air cushion between the turning bar and the web of material.

Pistons can be axially displaced in the interior of these turning bars which pistons, depending on their position inside the turning bar, will block a greater or fewer number of holes. This is done in order to match the width of the air cushion generated on the turning bar to the width of the web of material to be rerouted.

Such a matching of width is necessary, because compressed air escaping through the holes in the turning bar shell that is not covered by the web of material leads to an undesirable weakening of the air cushion which is generated by the holes covered by the web of material. As a result, the effect of the air cushion can be insufficient in the case of a narrow web of material. Moreover, the air currents exiting through the uncovered holes can interfere with the running of adjacent webs of material.

By using the turning bar disclosed in the above mentioned document, it is not possible to achieve an optimum matching of the shape of the air cushion to the course of the web of material. The reason for this is that the piston interiors are planar, while the edge of a web of material on the shell of the turning bar, which web of material typically is to be deflected by 90°, follows a helical line. If the piston is set in such a way that all of the holes which are not covered by the web of material are blocked, triangular zones are created in the edge areas of the web of material, in which zones the material web is not completely supported by an air cushion. If the pistons are set in such a way that the entire web is supported by an air cushion, holes which are supplied with compressed air necessarily remain uncovered.

To avoid this problem, pistons are used whose side facing the interior of the turning bar is not planar, but instead has edges whose courses respectively correspond on one half of the circumference to a right-turning helical line, and on the other half to a left-turning helical line. The pistons can be rotated around their axes within the turning bar so that, depending on the direction in which the web of material is rerouted, one or the other of the two helically-shaped edges can be turned toward the perforated portion of the circumference of the outside of the turning bar around which the web of material to be rerouted is looped.

By use of a piston shaped in this way it is possible to optimally use the compressed air available. The web of material is homogeneously supported by an air cushion over its entire width, and the escape of air which flows from uncovered holes is prevented.

In order to make use of the advantages of the piston described in the above mentioned U.S. patent, as well as those of the piston described here, every time the turning bar is used for rerouting a web of material of a different width, it is necessary to match the position of the pistons exactly to this material web width. Even if, instead of the width of material being changed, only the direction of rerouting the web of material is changed, this change can require a repositioning of the pistons. This process is very labor-intensive and arduous, because the pistons are not visible inside the shell of the turning bar. Although an operator can possibly look through the holes in the turning bar, as long as no web is conducted over the turning bar, in order to determine whether or not a hole is blocked by a piston, as soon as the web is being conducted over the turning bar, there is no longer an opportunity to check whether all holes covered by the web are indeed free, so that the air cushion is, in fact, generated over the required width.

DE 93 20 281 U1 discloses a pivotable turning bar which is coupled with an axially displaceable piston. The axial movement of the piston is coupled to the pivot movement of the turning bar. In another embodiment, a stationary motor, which displaces the piston via a flexible shaft, is provided for the axial movement of the piston.

U.S. Pat. No. 4,453,465 A discloses a pivotable turning bar, whose piston, which can be pivoted in the circumferential direction, is displaced by use of a gear.

SUMMARY OF THE INVENTION

It is the object of the present invention to provide a turning bar.

In accordance with the present invention, this object is attained by providing a turning bar, which is usable to guide a web of material, with a jacket that has a plurality of holes over at least a portion of its circumference. An interior chamber of the turning bar is supplied with compressed air. At least one blocking element is arranged in the interior chamber for the selective blockage of the holes. The turning bar is pivotable on a frame about an axis of rotation extending transversely to its longitudinal axis. Movement of the blocking element is coupled to the pivot movement of the turning bar.

The advantages to be obtained by the present invention consist, in particular, in that a matching of the position of the piston or pistons to the width, or to the position of a web of material on the turning bar can take place rapidly and definitely. Even the matching of the position of the piston or pistons, with a displacement of the web while the web is running, is easily possible.

To obtain these results and advantages, a motor for use in displacing the piston, and a control circuit are provided. The control circuit operates the motor in such a way that the piston takes up a desired position, which is determined by a control signal supplied by the control circuit.

Two types of signals in particular are considered for use as the control signal for the control circuit. One is a quantitative signal, i.e. a signal which can be assigned a numerical value and which makes it possible for the control circuit to operate the motor long enough until the piston has achieved a position corresponding to the numerical value. The other is a signal with at least two discrete states, one of which can be called a "prohibited" state, and the other of which can be called a "permitted" state, in which case the control can consist in operating the motor until the signal changes to the "permitted" state.

The first type of control signal is particularly suited for being picked up or generated at a device which is located upstream of the guide roller and which processes the web of material, such as a cutting tool. The control signal is formed either indirectly by measuring the position of an installation which determines the position of a web edge, or directly by derivation from a control signal which determines the position of such an installation.

A control signal of the second type can preferably be generated with the aid of a movable detector, which is coupled to the respective position of the piston for detecting the position of the web edge. In this case, the coupling can contain a mechanical connection between the piston and the detector. However, a coupling by mechanical control can be considered, in particular if the detector is distantly arranged along the path of the web of material.

A rapid and controlled adaptability of the piston position is particularly important in connection with a pivotable guide roller which is usable for permitting the selective deflection of the web of material in two different directions. The process of positioning the piston can be completely automated in this way, which further simplifies the adaptation of the guide roller in accordance with the present invention to various web widths, and possibly deflection directions.

A further advantage of the present invention resides in that following the pivoting of the turning bar, a separate work step of turning the piston for adapting the course of its edge to the course of the web edges can be omitted.

To prevent the escape of air through the slit, a sealing tape, which is being pressed against the edges of the slit by the air pressure, can advantageously be provided. In order to prevent an interference with the movement of the support by the sealing tape, the latter is preferably coupled to the piston and can be displaced in front of the slit.

Alternatively, the detector can also be applied inside the piston for use in detecting the presence or the absence of the web of material in front of one of the holes.

If the turning bar can be pivoted by 90° around an axis which is perpendicular with respect to the longitudinal axis of the guide roller, in order to selectively deflect the web of material in opposite directions, the edges of the web of material will describe a left-turning helical line or a right-turning helical line on the surface of the turning bar, depending on the direction of the deflection. By use of an axial rotation of the piston or pistons, it is always possible to bring the area of the piston edge, whose direction of rotation corresponds to that of the web edge, into contact with the perforated area of the surface of the guide roller in order to achieve, in this way, a course of the edge of the piston which is congruent with the course of the web edge.

To rapidly match the rotational position of the piston or pistons to the respective deflection direction, the axial rotation of the piston or pistons is preferably coupled to the pivot movement of the guide roller by the use of a gear.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
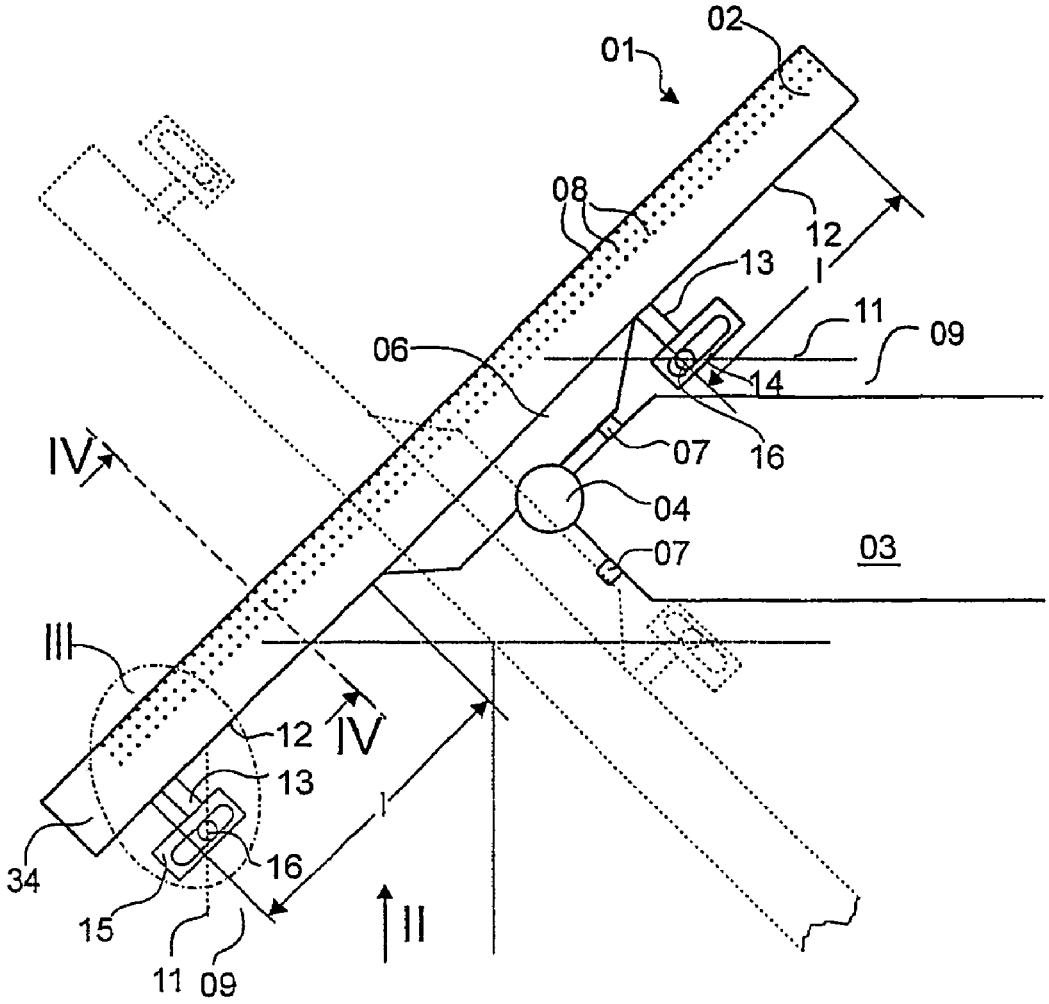
FIG. 1, a schematic view from above of a turning bar in accordance with the present invention, in FIG. 2, a side elevation view of the turning bar in FIG. 1, taken in the direction of the arrow II, in FIG. 3, a partial cross-section through the area of the turning bar identified by III in FIG. 1, in FIG. 4, a cross-section through the turning bar along the line IV—IV in FIG. 1, in FIG. 5, a sectional view through the end area of the turning bar in FIG. 1, in FIG. 6, an axial section through the center areas of the turning bar, in FIG. 7, a sectional view analogous to the one in FIG. 5 through the end area of a turning bar in accordance with a second preferred embodiment of the present invention, in FIG. 8, a cross-section through a turning bar in accordance with a third preferred embodiment, and in FIG. 9, a schematic representation of turning bars and their control in accordance with the present invention.

Turning initially to FIG. 1, there may be seen, generally at 01, a first preferred embodiment of a turning bar in accordance with the present invention. The turning bar 01, and which is shown in a view from above in FIG. 1, is a cylindrical hollow body, which is connected with a frame that is not specifically represented, by the use of a support arm 03 which is acting approximately on the center of a jacket 02 of the turning bar 01. The support arm 03 has a joint 04, which permits a pivotal movement of the turning bar 01 through an angle of 90° around an axis which extends perpendicularly to the plane of FIG. 1. The turning bar 01 is connected with the joint 04 by a connecting piece 06 which connecting piece 06, in the end positions of the pivot movement of the turning bar 01, comes into contact with one of two stops 07 situated on the support arm 03. The length of each of the stops 07 is adjustable in order to be able to adjust the freedom of movement of the turning bar to exactly 90°.

Figure 3:
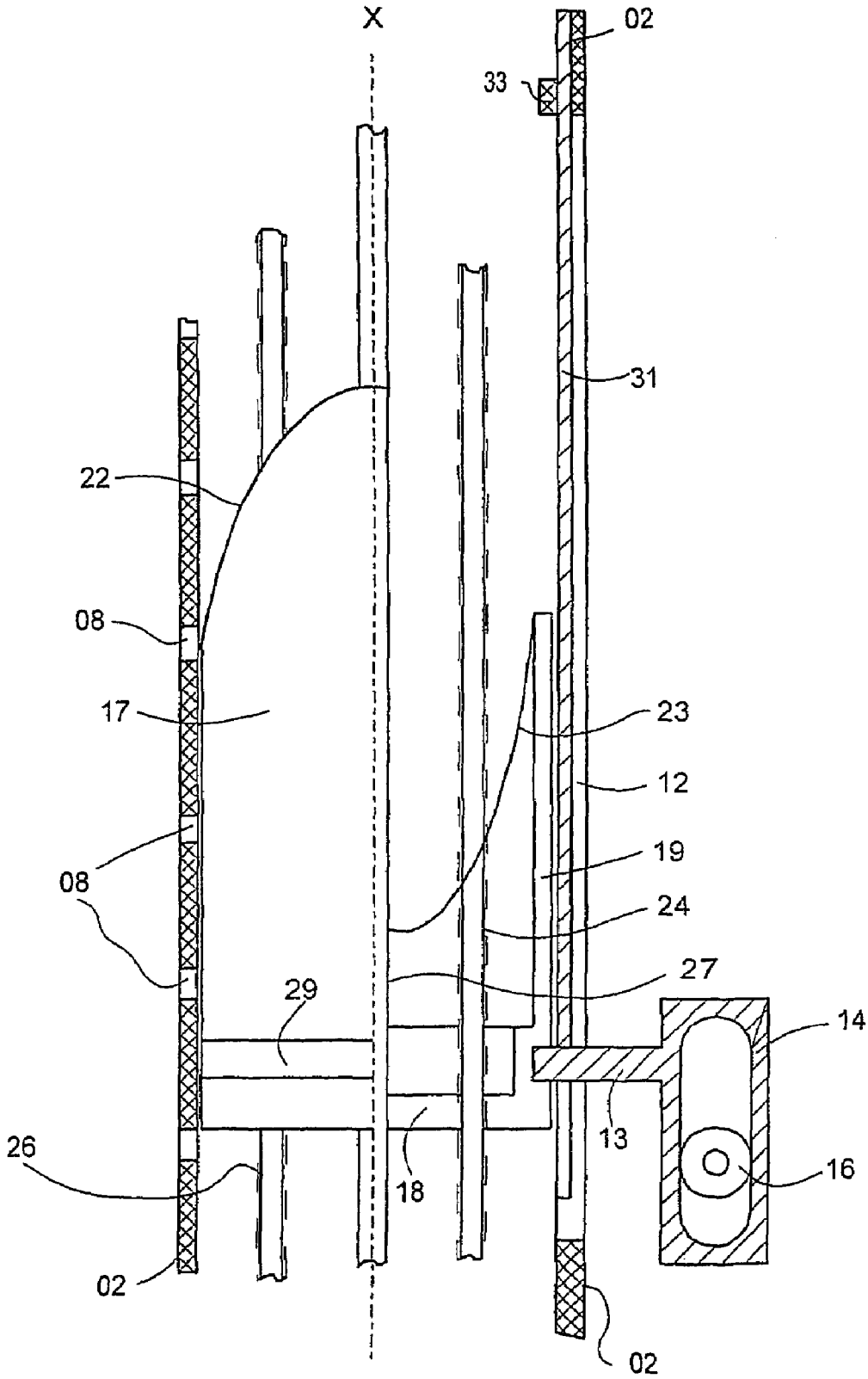

A compressed air feed line, which is not specifically represented, extends through the support arm 03, the joint 04 and the connecting piece 06, and through which compressed air feed line an interior chamber of the turning bar 01 is supplied with compressed air. This interior chamber is bordered by the turning bar jacket 02 and by two blocking elements, for example pistons 17, as seen in FIG. 3, which pistons 17 are axially displaceable inside the jacket 02 and whose structure will be discussed in greater detail in connection with FIG. 3. The turning bar jacket 02 is provided, on the half of its periphery that is facing away from the connecting piece 06, with a regular arrangement of holes 08, through which compressed air can escape from the interior chamber in order to form an air cushion for a web of material 09 that is deflected on the turning bar 01. In FIG. 1 this web of material 09 is shown as being transparent, its edges 11 are represented as dashed lines.

Figure 2:
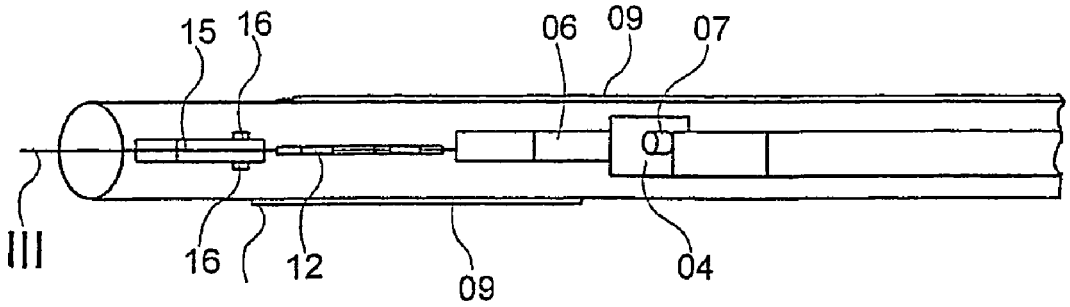

On the back of the turning bar jacket 02, which is facing away from the holes 08, two slits 12, each of a length l, are provided and extend in the longitudinal direction of the turning bar 01, on both sides of the connecting piece, one of which slits 12 can be seen in a side elevation view in FIG. 2. FIG. 2 represents a side elevation view of the turning bar 01 taken in the direction of the arrow II in FIG. 1. A rod 13, which connects a detector holder 14 or 15 with one of the two previously disclosed pistons 17 in the interior of the turning bar 01, extends through each of the two slits 12. In the preferred embodiment, the detector holder 14 is in the shape of a frame with an elongated hole, in which a detector unit of two photoelectric cells 16, as seen in FIG. 2, is held adjustably parallel with the longitudinal axis of the turning bar 01. As can be seen in FIG. 2, one of the two photoelectric cells 16 is oriented toward the top, or facing up, the other toward the bottom, or facing down. In the position of the turning bar 01 represented in FIG. 1, the downward oriented or facing photoelectric cell 16 of the detector holder 15 detects an edge 11 of the outgoing web of material 09. The upward oriented or facing photoelectric cell 16 in the detector holder 14 detects an edge 11 of the incoming web of material 09.

When the turning bar 01 is pivoted out of its first end position shown in solid lines in FIG. 1 by 90° into its second or other end position, shown by dashed lines in FIG. 1, the upward oriented or facing photoelectric cell 16 of the detector holder 15 detects an incoming edge 11, and the downward oriented or facing photoelectric cell 16 of the detector holder 15 detects an outgoing edge 11.

FIG. 3 is a partial cross-sectional view through the turning bar 01 shown in FIG. 1 and taken in the encircled area identified by III in FIG. 1. This partial cross-section shows a portion of the inner structure of the turning bar 01, and in particular one of the two pistons 17, which can be displaced in it. The level of the cross-sectional view is shown by the dash-dotted line identified by III in FIG. 1. The holes 08 and the slit 12 in the surface area of the turning bar 01 can be clearly seen in the cross-sectional view depicted in FIG. 3.

In FIG. 3, the piston 17 is shown in a view from above to the left of the longitudinal axis X—X of the turning bar 01, and in section to the right of the longitudinal axis. Piston 17 has the approximate shape of a cup with a bottom 18 and with a lateral wall 19, whose edge facing an interior chamber 21 of the turning bar 01 is formed by two helically shaped sections 22, 23, each with an opposite hand or direction of turning. In the position of the piston 17 represented in FIG. 3, the section 22 facing the holes 08 has a right-handed direction of turning, and the section 23 facing the slit 12 has a left-handed direction of turning.

In this orientation of the piston 17, as seen in FIG. 3, the right handed edge area 22 extends exactly parallel in respect to a web edge 11, which web edge is shown looped around the turning bar 01 in its position shown in solid lines in FIG. 1.

To be able to bring the course of the right handed edge section 22 of the piston 17 into exact congruence with the web edge 11, an axial displaceability of the piston 17 in the interior of the turning bar 01 is required. A first threaded spindle 24 is used for this purpose, which first threaded spindle 24 is in engagement with a screw thread in the bottom 18 of the piston 17 and which first threaded spindle 24 is rotatingly driven by an actuator, for example a motor 36, shown in greater detail in FIG. 5. A second threaded spindle 26, which can be rotatingly driven by the same motor 36, passes through an opening in the bottom 18 of piston 17 without engaging the screw thread. It is in engagement with a screw thread in the bottom 18 of a second piston 17, which second piston 17 is configured analogously to the depicted piston 17, and which second piston 17 is housed diametrically opposite the first, depicted piston 17 in the turning bar 01.

Figure 5:
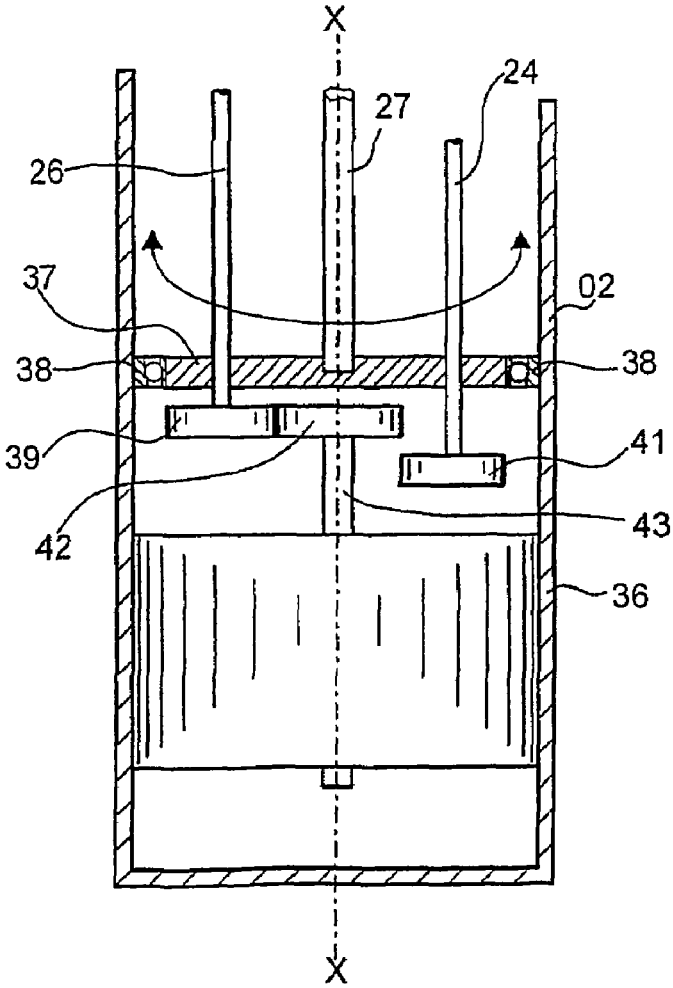

A rod 27, which, as seen in FIG. 5, has a square cross section, extends along the axis X—X of the turning bar 01 and passes, with little play, through an opening in the bottoms 18 of both pistons 17. It is fixedly connected with a gear 44, 46, 27, represented in FIG. 6, and is used for rotating the pistons 17 around the axis X—X in response to the pivoting of the turning bar 01 between its two stop positions.

An annular groove 28, in which a ring 29 can be rotated, is formed in the vicinity of the piston bottom 18 in the piston lateral wall 19. The ring 29 is fixedly connected with the previously described rod 13 on which the detector holder 14 is arranged. It is possible, by use of the ring 29, to rotate the piston 17 about the axis X—X without the detector holder 14 having to follow this rotating movement. Furthermore, a sealing strip 31, which extends over the entire length of the slit 12, and which slit 12 is open toward the interior chamber 21, has been attached to the rod 13, as seen in FIG. 4.

Figure 4:
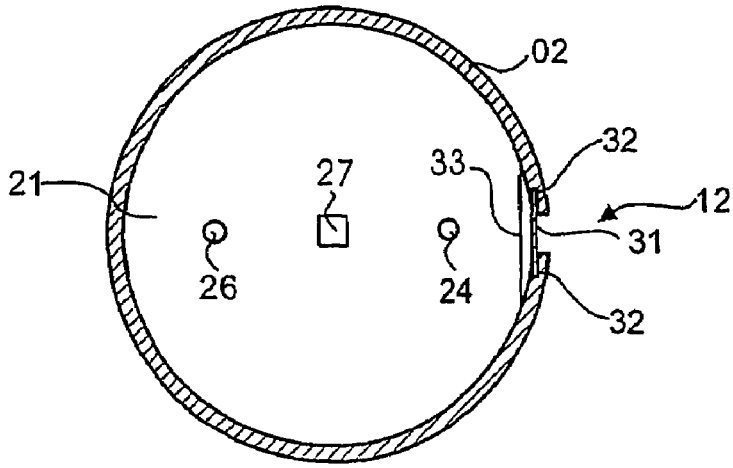

FIG. 4 shows this above described arrangement in a cross-sectional view at the height of the line IV—IV in FIG. 1. Over its entire length, the sealing strip 31 is inserted into recesses 32 on both sides of the slit 12, so that it does not hinder the rotatability of the pistons 17. A bracket 33 can be attached to the end of the slit 12 facing the connecting piece 06, as seen in FIGS. 3 and 4, which maintains the sealing strip 31 pressed against the jacket 02 even when the interior chamber 21 is not charged with pressure and assures, in this way, that sealing strip 31 performs its sealing function as soon as compressed air is introduced into the interior chamber 21.

FIG. 5 shows a section along the longitudinal axis X—X of the turning bar 01 through its end area 34, which end area 34 of turning bar 01 is identified in FIG. 1. The previously mentioned motor 36 is housed in this end area 34 in a chamber, which is delimited in the direction toward the pistons 17, which is an upward direction, as seen in FIG. 5, by a plate 37. The plate 37 is maintained rotatably in the jacket 02 with the aid of a rolling bearing 38. The square cross-section rod 27 is engaged, fixed against relative rotation, with the plate 37. The threaded spindles 24, 26 are rotatably extended through the plate 37, and each one has a driven wheel 39, 41 on its end in the interior of the chamber. A drive wheel 42, which is complementary to the driven wheels 39, 41, has been mounted on the driveshaft 43 of the motor 36. The driveshaft 43 can be displaced in the direction of the longitudinal axis X—X between the position shown in FIG. 5, in which the drive wheel 42 is in engagement with the driven wheel 39, and an engagement position with the driven wheel 41. Thus, by the selective displacement of the driveshaft 43, the motor 36 can be selectively used for displacing either piston 17. The wheels 39, 41, 42 can be friction wheels or gear wheels, to make the engagement of the wheels with each other easier, the driven wheels 39, 41 can be frustoconical, and the drive wheel 42 can be double-frustoconical.

When the turning bar 01 is pivoted, for changing the deflection direction of the web of material 09, this requires, as already stated above, a rotation of the pistons 17 by 180°. The threaded spindles 24, 26 follow this rotation, so that they exchange places in FIG. 5. The motor 36 is not rotated during this rotation of the pistons, so that the engagement of the drive wheel 42 with one of the driven wheels 39, 41 can be maintained in the course of this rotation and in spite of this rotation. It is, of course, also possible to cause the selective displacement of both pistons 17 with the aid of only one motor 36 with the aid of a different coupling mechanism than the one described above. It is also conceivable to assign each threaded spindle 24, 26 its own motor, each of which motor, in this case, could be attached to the respective end of the turning bar 01 which is adjoined by the piston 17 that is driven by the motor. This motor can be arranged fixed in place, or in such a way that it follows the rotating movement of the bar.

Figure 6:
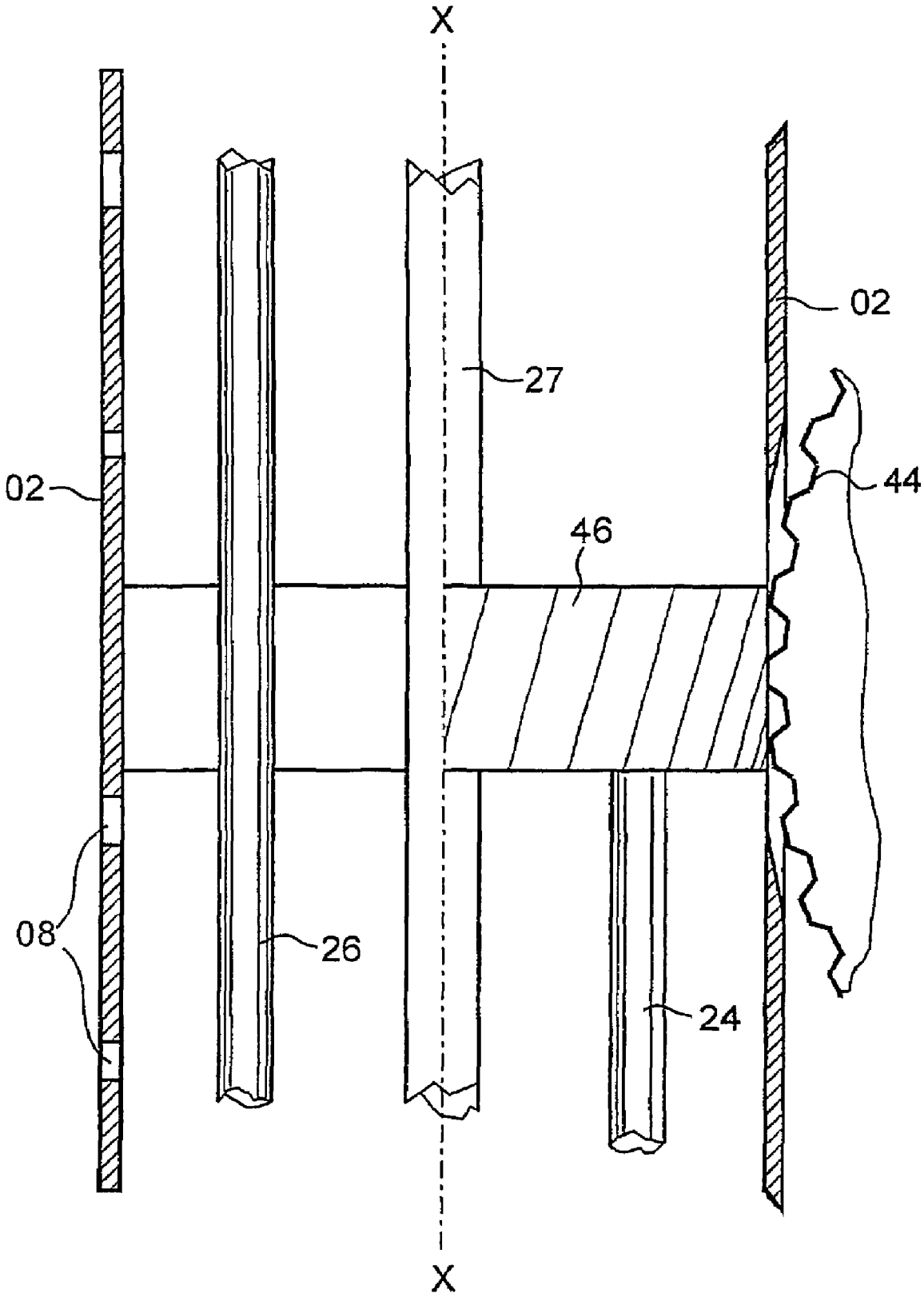

FIG. 6 shows a drive mechanism that is usable for effective a rotation around 180° of the pistons 17 in response to a pivot movement of the turning bar 01 from one of its work positions into the other. The reference numeral 44 indicates a portion of a drive gear wheel, or a drive gear wheel segment, which is housed in the connecting piece 06. This drive gear wheel, or drive gear wheel segment, 44 can be arranged fixed in place in the connecting piece 06, but could also be coupled to the position of the turning bar 01 in such a way that it performs a rotation itself in response to a pivot movement of the turning bar 01. This drive gear wheel, or drive gear wheel segment, 44 meshes through a helical gearing with a further, or driven gear wheel 46, which is rotatable around the longitudinal axis X—X of the turning bar 01 and which substantially fills the free cross section of the interior chamber 21 of the turning bar 01. In FIG. 6, this driven gear wheel 46 is shown in section to the left of the longitudinal axis X—X, and in a top plan view to the right of the axis. Driven gear wheels 46 is fixedly connected with the rod 27. The threaded spindle 26, which is used for driving the piston 17 at the end of the turning bar 01 facing away from the motor 36, is passed, freely rotatable, through a bore in the driven gear wheel 46. The threaded spindle 24, which is used for driving the piston 17 adjoining the motor 36, is rotatably seated in the driven gear wheel 46. The drive gear wheel, or drive gear wheel segment, 44 and the driven gear wheel 46 are laid out in such a way that they convert a pivot movement of the turning bar 01 by 90° around the axis of the joint 04 into a rotation by 180° of the driven gear wheel 46, and therefore of the pistons 17. In this way, the gear train 44, 46, 27 shown in FIG. 6 assures that the pistons 17 are in a rotation orientation respectively matched to each one of the two working positions of the turning bar 01.

To match the turning bar 01 to the guidance of a fresh web of material 09, it is possible to proceed as follows. First, the pistons 17 are displaced into their stop positions adjoining the respective ends of the turning bar 01 by operation of the motor 36 and the threaded spindles 24 and 26. In this position of the pistons, the detectors are not located opposite a web of material 09 guided over the turning bar 01. A signal level supplied by the detector unit in this state is considered to be a "prohibited" level.

Thereafter, each of the pistons 17 is displaced out of its stop position toward the center of the turning bar 01 until the detector unit of each piston 17 registers a web edge 11 and changes its output signal to a "permitted" level. Since, in each of the two working positions of the turning bar 01, only one of the two photoelectric cells 16 of each detector unit can lie opposite only one web edge 11, it suffices for evaluating the detector signal to evaluate an OR-linkage of the signals generated by the two photoelectric cells 16 of each detector unit for detecting that the web edge 11 has been detected by the detector unit. To increase the detection assurance, it can also be provided that, depending on the working position of the turning bar 01, only one of the two photoelectric cells 16 of each detector unit is operated. A control circuit for performing this task is not separately represented in FIG. 6.

When the position of the detector unit 16 in each of the detector holders 14, 15 has been correctly adjusted, at the moment at which the detector unit 16 registers the web edge 11, the position of the edge section 22 or 23 of the piston 17 facing the outside of the jacket 02 exactly corresponds to the course of the edge 11 of the web of material 09 on the turning bar 01. Thus, the two pistons 17 cut off or occlude all of those holes 08 on the jacket 02 of the turning bar 01 from the compressed air supply out of the interior chamber 21, which are not covered by the web of material 09; however, it is possible to generate a homogeneous air cushion over the entire surface under the web of material 09.

Figure 7:
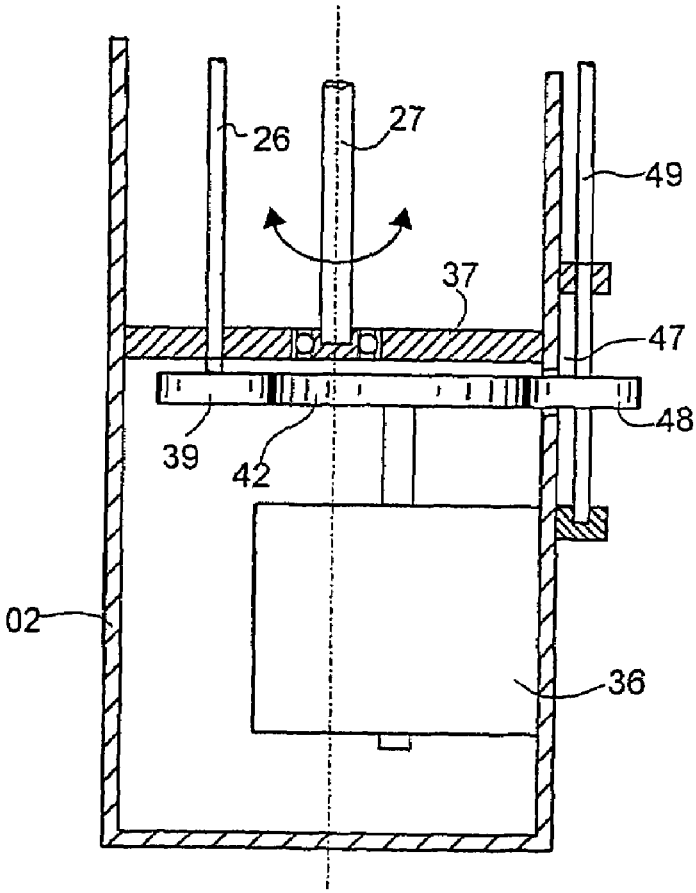

FIG. 7 shows a sectional view through the end area of the turning bar 01 in accordance with a second preferred embodiment of the present invention. The position of the section is the same as in FIG. 5. Elements which correspond in their shape or function to elements in the previously described first preferred embodiment have been provided with the same reference symbols. In this second preferred embodiment, the plate 37 is connected, fixed against relative rotation, with the jacket 02, the rod 27 is rotatably seated on the plate 37. Through the wheels 42, 39, the motor 36 drives only one spindle 26 of one of the pistons 17; a corresponding motor for the other piston is located at the other end of the turning bar 01. An exterior wheel 48, acting through a slit 47 in the jacket 02, is in engagement with the drive wheel 42. Exterior wheel 48 transmits a rotation of the motor 36 to a threaded spindle 49, which is maintained outside of the turning bar 01 parallel with the latter. This threaded spindle 49 drives a detector holder, which is not represented in FIG. 7, such as the detector holder 14 in FIG. 1, to make a movement of the detector holder which is coupled to the movement of the piston 17.

Figure 8:
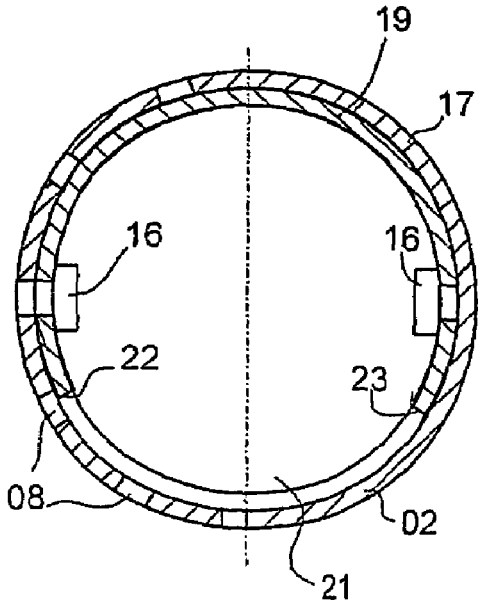

FIG. 8 shows a third preferred embodiment of the turning bar 01 of the present invention in cross section. The essential difference between the previously described first and second preferred embodiments and the third preferred embodiment in accordance with FIG. 7 is the arrangement of the detectors. The detectors can again be photoelectric cells 16, for example. In the third embodiment in accordance with FIG. 8, these photoelectric cells 16 are arranged in the interior of the turning bar 01. They are respectively embedded in the lateral wall 19 of the pistons 17, each in the vicinity of the piston edge section 22, 23, so that they can detect the presence of the web 09 as long as the detectors 16 are located in front of one of the holes 08. Although with this embodiment the accuracy with which the position of the web edge 11 can be detected is limited by the distance of the holes 08 in the axial direction, this does not interfere with the functionality of the device, since the piston 17 in the interior of the turning bar 01 can be displaced by just this distance without the number of the open or blocked holes being changed by this.

With this third embodiment, a flow sensor in particular can be employed, which flow sensor registers the flow of air from the interior chamber 21 to the outside when the flow of air passes a hole 08 which is not covered by the web of material 09.

Figure 9:
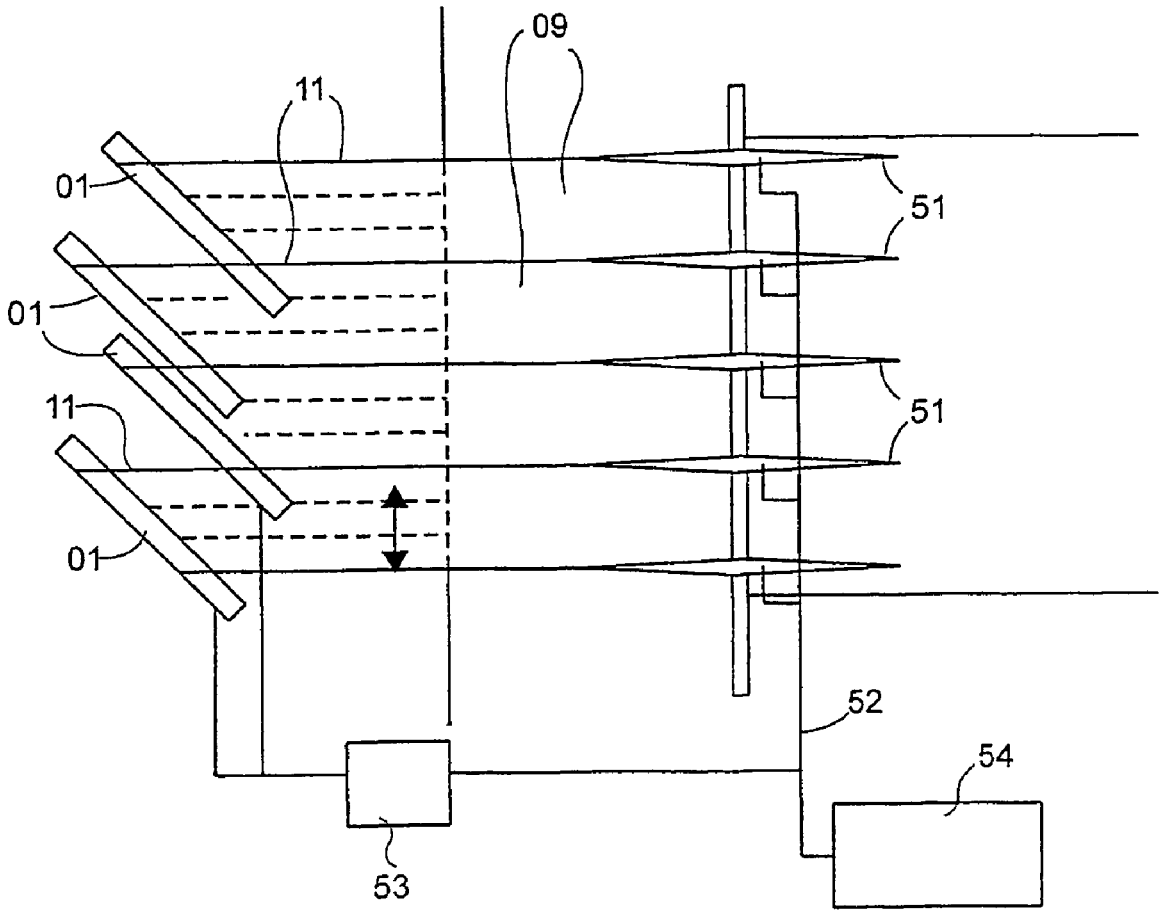

FIG. 9 shows a schematic representation of turning bars 01 and their control in accordance with the present invention. A plurality of turning bars 01 are arranged, for example, following a cutting device, in which a web of material 09, in particular an imprinted paper web 09, is cut into a plurality of partial webs 09, each of which partial webs 09 is deflected by a turning bar 01. The position of the individual rotating cutters 51 of the cutting device can be set at a control console 54. A control signal, indicating the desired position of each cutter 51, is supplied to actuating units, which are not specifically represented, of the cutters 51, via a signal line 52. This control signal, which simultaneously also defines the position of the edges 11 of the partial webs 09 cut by the cutters 51, is branched off to a control circuit 53 which calculates from this control signal, and taking into consideration the positions of the turning bars 01, which can be displaced transversely to the web direction, the respective desired positions of the pistons 17 in the interior of the turning bars 01 and actuates their motors 36 in order to cause the pistons 17 take up this desired positions.

Alternatively, the control signal could also be obtained with the aid of position detectors, which measure the position of the cutters 51, or of the web edges 11 created by them, in the cutting direction.

In order to set the desired position calculated in this way, the control circuit can maintain the actual position of each individual piston 17 in a memory, can calculate the difference between both positions, and can operate each motor 36 at a known rotational speed until the respective piston 17 should have changed from the actual position into the desired position. The control circuit also has an operating state for displacing the respective piston 17 to an end position. This operating state is independent of the control signal.

It is alternatively possible to provide an operating state of the control circuit 53 in which, for matching a changed web width or a changed position of the turning bars, each piston 17 initially moves into a stop position. Once this has been reached, a change into a control state is made, in which the control circuit, starting at this exactly known stop position, arrives at the desired position by operating the motor 36 for a calculated angle of rotation or a calculated time at a known rotational speed.

A first actuating element for pivoting the turning bar and a second actuating element for moving the blocking element are alternatively arranged. The two actuator elements are electrically coupled.

While preferred embodiments of a turning bar in accordance with the present invention have been set forth fully and completely hereinabove, it will be apparent to one of skill in the art that various changes in, for example the printing press with which the turning bar is used, the type of cutters used to cut the web, the widths of the webs and the like could be made without departing from the true spirit and scope of the present invention which is accordingly to be limited only by the appended claims.

What is claimed is:

1. A turning bar usable to guide a web of material comprising:

a jacket;

a plurality of holes on at least a portion of a circumference of said jacket;

an interior chamber adapted to receive compressed air and to direct the compressed air to said jacket circumference through said plurality of holes;

at least one movable piston, said at least one movable piston being movable in a longitudinal direction along a longitudinal axis of said turning bar and being movable in a circumferential direction of said jacket, said at least one movable piston being usable to block selected ones of said plurality of holes;

a frame supporting said turning bar for pivotable movement through 90° about an axis of rotation extending transversely to said longitudinal axis of said turning bar; and a gear mechanism for coupling said movement of said piston in said circumferential direction of said jacket to said pivotal movement of said turning bar, said gear mechanism converting said 90° pivot movement of said turning bar into 180° rotation of said piston in said circumferential direction of said jacket.

2. The turning bar of claim 1 further including a motor for driving said at least one movable piston in said longitudinal direction of said turning bar.

3. The turning bar of claim 2 wherein said motor is rotatable with said at least one movable piston.

4. The turning bar of claim 2 further including a first wheel coupled to a shaft of said motor and a second wheel, said second wheel being rotatable around said first wheel in response to said circumferential movement of said at least one movable blocking element, and being non-positively connected to said first wheel.

5. The turning bar of claim 2 further including a control circuit for operating said motor, said control circuit receiving a control signal and operating said motor to position said at least one movable piston.

6. The turning bar of claim 5 wherein said control signal is a quantitative signal and further wherein said control circuit operates said motor until a rotatory travel of said at least one movable piston in response to said control signal has been accomplished.

7. The turning bar of claim 5 wherein said control circuit has an operating state for displacing said at least one movable piston to an end position, which is independent of said control signal.

8. A turning bar usable to guide a web of material comprising:

a jacket;

a plurality of holes on at least a portion of a circumference of said jacket;

an interior chamber adapted to receive compressed air and to direct the compressed air to said jacket circumference through said plurality of holes;

at least one movable blocking element, said at least one movable blocking element being movable in a longitudinal direction along a longitudinal axis of said turning bar and being movable in a circumferential direction of said jacket, said at least one movable blocking element being usable to block selected ones of said plurality of holes;

a frame supporting said turning bar for pivotable movement through 90° about an axis of rotation extending transversely to said longitudinal axis of said turning bar; and a gear mechanism for coupling said movement of said blocking element in said circumferential direction of said jacket to said pivotal movement of said turning bar, said gear mechanism including a crown gear that is rotatable about said longitudinal axis and which meshes with teeth that are fixed in place.

9. The turning bar of claim 8 wherein said jacket includes a slit and further wherein said teeth engage said crown gear inside said jacket through said slit.

10. The turning bar of claim 8 wherein said gear mechanism includes a non-circular rod, said at least one blocking element being supported on said non-circular rod fixed against rotation with respect to said non-circular rod and being axially displaceable along said non-circular rod.

11. The turning bar of claim 8 further including a motor for driving said at least one movable blocking element in said longitudinal direction of said turning bar.

12. The turning bar of claim 11 wherein said motor is rotatable with said at least one movable blocking element.

13. The turning bar of claim 11 further including a control circuit for operating said motor, said control circuit receiving a control signal and operating said motor to position said at least one movable blocking element.

14. The turning bar of claim 13 wherein said control signal is a quantitative signal and further wherein said control circuit operates said motor until a rotatory travel of said at least one movable blocking element in response to said control signal has been accomplished.

15. The turning bar of claim 14 wherein said control signal is a signal with two discrete states, a prohibited state and a permitted state, and wherein when said control signal contains said prohibited state, said control circuit operates said motor until said control signal transitions into said permitted state, and further including a detector inside said at least one movable blocking element, said detector detecting a presence or an absence of a web of material in front of one of said holes.

16. The turning bar of claim 13 wherein said control circuit has an operating state for displacing said at least one movable blocking element to an end position, which is independent of said control signal.

17. The turning bar of claim 13 further including a detector coupled to said at least one movable blocking element, said detector providing said control signal.

18. The turning bar of claim 17 wherein said detector is a photoelectric cell.

19. The turning bar of claim 17 wherein said detector is mounted on said at least one movable blocking element.

20. The turning bar of claim 19 further including a slit in said jacket and a support passing through said slit, said detector being attached to said support outside of said slit and said at least one movable blocking element being attached to said support inside said jacket.

21. The turning bar of claim 20 further including a sealing tape engageable with edges of said slit and pressed against said edges by the compressed air in said interior chamber.

22. The turning bar of claim 21 wherein said sealing tape is coupled to said at least one movable blocking element and can be displaced in front of said slit.

23. The turning bar of claim 19 wherein said detector is attached inside said at least one movable blocking device for detecting the presence or absence of a web of material in front of one of said holes.

24. A turning bar usable to guide a web of material comprising:

a jacket;

a plurality of holes on at least a portion of a circumference of said jacket;

an interior chamber adapted to receive compressed air and to direct the compressed air to said jacket circumference through said plurality of holes;

at least one movable blocking element, said at least one movable blocking element being movable in a longitudinal direction along a longitudinal axis of said turning bar and being movable in a circumferential direction of said jacket, said at least one movable blocking element being usable to block selected ones of said plurality of holes;

a frame supporting said turning bar for pivotable movement through 90° about an axis of rotation extending transversely to said longitudinal axis of said turning bar;

a gear mechanism for coupling said movement of said blocking element in said circumferential direction of said jacket to said pivotal movement of said turning bar;

a motor for driving said at least one movable blocking element in said longitudinal direction of said turning bar; and a control circuit for operating said motor, said control circuit receiving a quantitative control signal and operating said motor to position said at least one movable blocking element until a rotatory travel of said at least one movable blocking element in response to said control signal has been accomplished, said control signal being a signal with two discrete states, a prohibited state and a permitted state, and wherein when said control signal contains said prohibited state, said control circuit operates said motor until said control signal transitions into said permitted state, and further including a detector inside said at least one movable blocking element, said detector detecting a presence or an absence of a web of material in front of one of said holes.

25. A turning bar usable to guide a web of material comprising:

a jacket;

a plurality of holes on at least a portion of a circumference of said jacket;

an interior chamber adapted to receive compressed air and to direct the compressed air to said jacket circumference through said plurality of holes;

at least one movable blocking element, said at least one movable blocking element being movable in a longitudinal direction along a longitudinal axis of said turning bar and being movable in a circumferential direction of said jacket, said at least one movable blocking element being usable to block selected ones of said plurality of holes;

a frame supporting said turning bar for pivotable movement through 90° about an axis of rotation extending transversely to said longitudinal axis of said turning bar;

a gear mechanism for coupling said movement of said blocking element in said circumferential direction of said jacket to said pivotal movement of said turning bar;

a motor for driving said at least one movable blocking element in said longitudinal direction of said turning bar;

a control circuit for operating said motor, said control circuit receiving a control signal and operating said motor to position said at least one movable blocking element; and a detector mounted on said at least one movable blocking element, said detector providing said control signal.

26. The turning bar of claim 25 wherein said detector is a photoelectric cell.

27. The turning bar of claim 25 further including a slit in said jacket and a support passing through said slit, said detector being attached to said support outside of said slit and said at least one movable blocking element being attached to said support inside said jacket.

28. The turning bar of claim 27 further including a sealing tape engageable with edges of said slit and pressed against said edges by the compressed air in said interior chamber.

29. The turning bar of claim 28 wherein said sealing tape is coupled to said at least one movable blocking element and can be displaced in front of said slit.

30. The turning bar of claim 25 wherein said detector is attached inside said at least one movable blocking device for detecting the presence or absence of a web of material in front of one of said holes.

* * * * *